United States Patent [19]

Stavitsky et al.

[11] Patent Number: 4,904,354

[45] Date of Patent: Feb. 27, 1990

[54] AKALINE CYANIDE-FREE CU-ZU STRIKE BATHS AND ELECTRODEPOSITING PROCESSES FOR THE USE THEREOF

[75] Inventors: Robert Stavitsky, Bronx; Basil D. Lovelock, Massapequa Park, both of N.Y.

[73] Assignee: LeaRonal Inc., Freeport, N.Y.

[21] Appl. No.: 269,240

[22] Filed: Nov. 9, 1988

Related U.S. Application Data

[63] Continuation of Ser. No. 35,977, Apr. 8, 1987, abandoned.

[51] Int. Cl.[4] ..... C25D 3/58; C25D 5/10

[52] U.S. Cl. ..... 204/40; 204/44

[58] Field of Search ..... 204/44, 40; 428/658, 428/659, 674, 676

[56] References Cited

U.S. PATENT DOCUMENTS

| | | | |
|---|---|---|---|
| 2,221,562 | 11/1940 | Wernlund | 204/40 X |
| 3,706,634 | 12/1972 | Kowalski | 204/46 |
| 3,706,635 | 12/1972 | Kowalski | 204/46 |
| 4,157,941 | 6/1979 | Donakowski | 204/33 |
| 4,356,067 | 10/1982 | McCoy . | |

FOREIGN PATENT DOCUMENTS

| | | |
|---|---|---|
| 214396 | 10/1984 | German Democratic Rep. . |
| 3896 | 9/1986 | Japan . |
| 865995 | 9/1981 | U.S.S.R. . |

*Primary Examiner*—G. L. Kaplan

*Attorney, Agent, or Firm*—Scully, Scott, Murphy & Presser

[57] ABSTRACT

Alkaline cyanide-free copper strike baths are provided for the purposes of electrodepositing a copper-zinc alloy strike coating unto a metal based substrate so as to prevent immersion coating by the copper on the metal substrate and thereby provide a basis for the subsequent addition to the substrate of composite electrodeposits which are blister free and highly adherent. Electrochemical coating processes for employing such strike baths and the resulting products are disclosed.

33 Claims, No Drawings

AKALINE CYANIDE-FREE CU-ZU STRIKE BATHS AND ELECTRODEPOSITING PROCESSES FOR THE USE THEREOF

This is a continuation of of copending application Ser. No. 035,977 filed on Apr. 8, 1987, and now abandoned.

BACKGROUND OF THE INVENTION

1. Field of the Invention

The present invention relates to strike baths containing zinc and copper, and designed to provide improved adhesion to zinc and other metal substrates of strike coatings electrodeposited from such baths on such substrates. The resulting improved adhesion of the strike coating also improves the adhesion to such substrates of plating coatings electrodeposited over said strike coating.

2. Description of the Prior Art

Zinc based die-castings have been in use for many years for fabricating parts for automotive use, household appliances, and many other parts that are advantageously fabricated from zinc based die-castings.

The method of preparing zinc based die-castings for subsequent electroplating is well-known in the art and is fully discussed in standard textbooks. The coating process cycle generally involves pre-coating operations designed to clean the metal substrate to be electroplated. These cleaning operations can include vapor degreasing, emulsion cleaning, cleaning in di-phase type cleaners and/or cleaning with various detergents. The primary purpose of the pre-coating cleaning step is to remove the bulk of any soil that may be contaminating the surface of the metal substrate to be electrocoated. The next step is an aqueous rinsing of the cleaning agents followed by an alkaline cleaning using an anodic or cathodic electrocleaning process, with the former process being preferred. After another aqueous rinsing to remove the alkaline cleaning agents, the castings are neutralized in a very mild acid dip, followed by a thorough aqueous rinsing. The next step in the prior art cycle is copper striking in a cyanide copper strike bath to promote adhesion of the composite electrodeposit to the die-casting substrate. After the castings have been initially coated with a thin layer (about 5 to 50 microinches) of copper from this copper strike solution, they are generally plated to a heavy thickness (about 0.1 to 0.5 mils) from a cyanide copper plating bath or any other suitable copper plating bath. The thus coated die-casting can then be finished by plating with nickel followed by chromium or plated with silver, gold, or any other desired finish.

Typical methods for preparing zinc base die-castings for plating are fully described in ASTM, B252-69(77) and summarized in *Metal Finishing Guidebook* 1984, page 173. All of the treating solutions used for the preparation of zinc die-castings for plating are important in order to achieve the required adhesion of the final electrodeposit to the zinc substrate. However, the most critical solution is the copper strike electrolyte.

The major difference between a copper strike electrolyte or solution and a copper plating solution, is the concentration of copper used in the respective solutions. Cyanide copper strike solutions contain about 15 to 30 g/l (grams/liter) of copper metal and about 5 to 15 g/l of free cyanide. Cyanide copper plating solutions used for electroplating heavy coppers layers contain about 60 to 75 g/l of copper metal and about 7 to 15 g/l of free cyanide. The lower metal content of the copper strike solutions promotes good adhesion of the composite electrodeposit to the zinc substrate.

The term composite electrodeposit means, in accordance with the present invention, the combination of the relatively thin strike coating and the subsequently applied relatively thick plating coating. The strike coating is electrodeposited and the subsequent plating coatings may be electrodeposited or electroless coatings. Only one strike coating is usually used, whereas one or more plating coatings may be applied over the strike coating. Where a plurality of the plating coatings are used, they may be based on the same or different metals as listed above.

The use of cyanide compounds in commercial electroplating baths is not desirable due to the extremely poisonous nature of such materials. The effluent from these cyanide-based baths must be treated chemically to remove all cyanides before being discharged to an environmentally acceptable waste effluent. The industry has been searching for many years for a cyanide-free plating sequence for plating zinc, and in particular zinc based die-castings, which is also capable of imparting the required degree of adhesion needed for such materials and thus equal to the adhesion that can now be achieved by using cyanide-based solutions.

Alkaline cyanide-free copper plating baths are known in the art, and comprise copper metal and a suitable amount of a complexing or chelating agent. These baths contain about 15 to 35 g/l of copper metal and a (stoichiometric) excess of complexing or chelating agent above that required to keep the copper in solution. Many chelating and complexing agents have been used both in laboratories and in industry for these baths. They include phosphate type compounds such as pyrophosphates, organic phosphonates, complex phosphates; carboxylate compounds such as citrates, bluconates, glucoheptonates; amine carboxylate compounds such as ethylenediaminetetracetic acid (EDTA), nitrilotriacetic acid (NTA) or glycine or its derivatives; and organic amines. Examples of organic phosphonate copper plating baths are found in U.S. Pat. Nos. 3,833,486 and 3,475,293. Examples of copper-zinc alloy plating baths based on glucoheptonates are found in U.S. Pat. Nos. 4,356,067, 4,389,286 and 4,417,956.

Examples of copper strike baths for plating zinc die-castings is given in *Plating*, Vol. 55, Mar. 1968, p. 233–7. Alkaline copper strike baths are described based on pyrophosphates and good adhesion is claimed when the bath is ultrasonically agitated. Without ultrasonic agitation, adhesion is poor. This method for plating zinc die-castings was not accepted by industry due to the high cost of the relatively large ultrasonic equipment installations needed for such purposes.

Although cyanide-free alkaline copper plating baths are known, none of these have achieved wide industry acceptance as suitable for plating directly onto zinc, and in particular zinc based die-castings, since they cannot achieve a satisfactory degree of adhesion, such as that equal to the degree of adhesion that can be achieved from cyanide-based baths. The prior art copper strike baths that are low in copper concentration and are based on cyanide-free formulas also results in an unsatisfactory level of adhesion that is not equal to that obtained when using cyanide copper strikes.

The poor adhesion obtained using prior art alkaline cyanide-free copper and copper alloy strike and plating baths is mainly caused by their tendency to plate a poorly adherent layer of copper or alloying metal onto the zinc substrate by immersion. When the cleaned and properly prepared zinc die-casting is immersed in a strike bath for a strike electrodeposit, there may be a tendency to form a poorly adherent layer of metal from the bath onto the zinc by immersion before electroplating takes place. Such an immersion deposit causes poor adhesion of subsequently applied electrodeposits. The strike bath solution of choice to date for obtaining the required degree of adhesion has been the alkaline cyanide-based copper strike bath which does not plate copper by immersion onto zinc.

The term "coating by immersion" as used herein means that a thin (about 1 to 5 microinches) coating of the metal(s) dissolved in the strike bath plate(s) out on the surface of a metal substrate when the substrate is merely immersed in the bath at the normal bath operating conditions of temperature and bath component concentrations, but in the absence of any electric current applied thereto.

U.S. Pat. No. 4,356,067 discloses the addition of zinc to an alkaline cyanide-free copper plating bath to deposit a copper-zinc alloy. Although the patent generally teaches that its plating baths may have a pH of about 10 to about 13.5, all of the examples in this patent show the use of relatively large amounts of Na, K, or Li hydroxide in the plating bath, which would provide for pHs thereof of about 12 to 14, and ammonium hydroxide is said to be unsuitable since it is not sufficiently alkaline. These baths that are relatively highly alkaline, i.e., those having a pH of above 11.5, tend to readily attack the zinc die-casting placed therein and deposit zinc thereon by immersion which would result in poor adhesion of any coatings made therewith and any subsequent electrodeposits.

Furthermore, it has been found that the glucoheptonate complexing agent used in these baths is not, in fact, a good complexing agent for zinc at any pH, and in addition does cause problems with respect to the waste treating of rinse waters emanating from the use of baths containing such complexing agent since it will not readily permit the residual copper content of the rinse water to be low enough to meet federal and/or local government standards for environmentally discharged waste water. Ideally, the complexing agents used should be readily removable from the waste rinse water together with the metals complexed therewith so that the metal content in these waters is low enough to comply with the minimums set by the relevant government regulations.

Prior to the present invention, therefore, alkaline cyanide-free copper strike baths were not available for the purposes of providing acceptable levels of adhesion between strike coatings applied from such baths and the metal substrates to which such strike coatings were applied, and particularly with rrespect to strike baths whose effluent can readily be treated for the removal of residual metal values.

OBJECTS OF THE PRESENT INVENTION

An object of the present invention is to provide an alkaline cyanide-free strike bath which will provide useful levels of adhesion between strike coatings applied from such baths and the metal substrates to swhich such strike coatings are applied.

A further object of the present invention is to provide an alkaline, cyanide-free strike bath which will provide useful levels of adhesion between composite electrodeposits comprising strike coatings applied from such baths and the metal substrates to which such composite electrodeposits are applied.

A further object of the present invention is to provide an alkaline, cyanide-free copper strike bath from which any rinse water emanating therefrom may be readily treated so as to lower the residual metal value content therein to environmentally acceptable levels.

A further object of the present invention is to provide a striking process in which useful levels of adhesion are readily obtained between an alkaline, cyanide-free, copper-containing strike and a metal surface to which such strike, and any subsequently applied plating coating, are electrodeposited.

A further object of the present invention is to provide novel electroplated metal substrates having a copper-zinc strike coating therein.

A further object of the present invention is to provide novel copper striking baths, as is, or in concentrated form, and processes for using said baths, which will prevent or substantially retard copper immersion on metal substrates treated with such baths and processes.

SUMMARY OF THE PRESENT INVENTION

It has now been found that these and other objects of the present invention can be achieved by the use, as further described below, of cyanide-free copper strike baths containing zinc and certain chelating agents, and having certain pH values.

DESCRIPTION OF THE PREFERRED EMBODIMENT

The Strike Bath Components

The strike bath employed in the present invention is an aqueous cyanide-free alkaline bath containing water soluble sources of copper, zinc, chelating agents and alkalinity.

The strike baths may be prepared in concentrated or dilute form. It is the dilute form that is directly used for electrodepositing purposes, as further described below. The concentrated form may be used for shipping and storage purposes. The respective component concentrations and pH levels of these two forms of the bath are as follows:

| | Concentrated Form of Strike Bath range | Dilute Form of Strike Bath broad | Dilute Form of Strike Bath preferred range |
|---|---|---|---|
| copper, as element | 30–60 g/l | 1–15 g/l | 3–5 g/l |
| zinc, as element | 30–60 g/l | 1–15 g/l | 3–5 g/l |
| copper & zinc, as elements (combined) | 30–60 g/l | 2–15 g/l | 4–8 g/l |
| chelating agent | 200–400 g/l | 50–300 g/l | 50–150 g/l |
| pH | 7.5–12 | 7.5–12 | 8.0–11.0* |

*depending on chelating agent used.

The concentrated solutions are thus prepared at such level of concentrations of the components thereof as to be readily transformed into the dilute strike bath form by being diluted about 2 to 60, and preferably about 2 to 10 times, with water.

The copper is added to the baths in any form in which it may dissolve in the complex containing alkaline strike bath form and the preferred source thereof is copper hydroxide.

Copper as $Cu(OH)_2$ is preferred because it is readily placed in solution by the complexing agents employed therewith, as noted below. Other forms of copper that may be used for this purpose would include copper pyrophosphate ($Cu_2P_2O_7$); copper sulfate ($CuSO_4$), copper chloride ($CuCl_2$); copper carbonate [$CuCO_3$ or $CuCO_3.Cu(OH)_2$].

The zinc is added to the baths in any form in which it may dissolve in the complex containing alkaline strike bath, and the preferred source thereof is zinc oxide dissolved in sodium or potassium hydroxide to form sodium or potassium zincate.

Other useful sources of the zinc would be zinc sulfate, zinc chloride and zinc methane sulfonate.

The copper and zinc should also not be used in any form that would interfere with the complexing of such metals and/or the desired striking process, under the striking process conditions employed herein. Such forms of copper & zinc to be avoided, therefore, would include chromates which are known in the art to inhibit the desired striking properties of the electrolyte and cyanides which are toxic and thus to be avoided.

The copper and zinc are used in a weight ratio to each other, in elemental form, of about 2 to 1 of copper to 0.5 to 1 of zinc, and preferably of about 1 to 1. The amount of zinc used is not critical, and enough is used in the solution to co-deposit as a strike coating with the copper so that a copper-zinc alloy is thus deposited on the metal substrate being treated, which alloy will contain at least about 1 to 5 weight percent of zinc, based on the combined weight of the copper and zinc in such alloy. The alloy may contain up to about 10 to 50 weight % of zinc, with the balance being copper. The preferred of such alloys will contain about 90–95% copper.

The chelating agent that is used is one that is, itself, soluble in the alkaline strike bath and which maintains the Cu and the Zn in solution in such strike bath. The Cu and Zn form metal chelate ions with such chelating materials in the required pH range which is maintained during the use of the bath, since the solution is thus highly buffered by the chelating agent. Such buffering technique in electrochemical baths is discussed in *Kirk-Othmer's Encyclopedia of Chemical Technology,* 3rd Ed., Vol. 5, p. 339, at pages 362–363.

The chelating agents to be used in the process of the present invention are preferably chosen not only for their function as buffering and chelating agents in the operating alkaline strike bath, but also with respect to their ability to be readily removed by relatively simple procedures thereby permitting the removal of residual copper and zinc values from the rinse water derived therefrom.

Of course, where a given chelating agent has suitable utility in the operating alkaline strike baths in accordance with the teachings of the present invention, but it does not readily allow the residual copper or zinc values to be readily removed from the spent strike bath solution, one could still use such chelating agents in the operating strike bath for a given electrodepositing application, where the economics of preparing the composite electrodeposit system for such application would compensate for any added cost needed to provide a legally satisfactory level of purification of effluent from the spent strike bath or rinse waters emanating therefrom.

The chelating agents of the present invention are those able to chelate divalent metal ions. Some candidate chelating agents that may be selected for use, in a given application, in the strike baths of the present invention are pyrophosphates such as the alkali metal (K, Na, Li) pyrophosphates and others, disclosed at pages 344–345 of *Kirk-Othmer,* supra., i.e., polyphosphates
- sodium tripolyphosphate
- hexametaphosphoric acid aminocarboxylic acids
- ethylenediaminetetraacetic acid (EDTA)
- hydroxyethylethylenediaminetriacetic acid
- nitrilotriacetic acid (NTA)
- N-dihydroxyethylglycine
- ethylenebis(hydroxyphenylglycine)

1,3-diketones
- acetylacetone
- trifluoroacetylacetone
- thenoyltrifluoroacetone hydroxycarboxylic acids
- tartaric acid
- citric acid
- gluconic acid
- 5-sulfosalicyclic acid polyamines
- ethylenediamine
- triethylenetetramine
- triaminotriethylamine aminoalcohols
- triethanolamine
- N-hydroxyethylethylenediamine aromatic heterocyclic bases
- dipyridyl
- o-phenanthroline phenols
- salicyaldehyde
- disulfopyrocatechol
- chromotropic acid aminophenols
- oxine, 8-hydroxyquinoline
- oxinesulfonic acid oximes
- dimethylglyoxime
- salicyaldoxime Schiff bases
- disalicyaldehyde 1,2-propylenediimine tetrapyrroles
- tetraphenylporphin
- phthalocyanine sulfur compounds
- toluenedithiol (Dithiol)
- dimercaptopropanol
- thioglycolic acid
- potassium ethyl xanthate
- sodium diethyldithiocarbamate
- dithizone
- diethyldithiophosphoric acid
- thiourea synthetic macrocyclic compounds
- dibenzo~18]crown-6
- $(CH_3)_6$[14]4.11-diene $N_4$
- (2.2.2-cryptate)

polymeric
- polyethylenimine
- polymethacryloylacetone
- poly(p-vinylbenzyliminodiacetic acid)

phosphonic acids
- nitrilotrimethylenephosphonic acid ethylenediaminetetra(methylenephosphonic acid)
hydroxyethylidenediphosphonic acid The selection of a particular candidate chelating agent for use in a particular strike bath at a given pH value for treating a specific metal substrate therein would depend on the ability of such candidate chelating agent to provide, or have, the following characteristics relative to such proposed usage:

(1) it is capable of plating a copper-zinc alloy strike therefrom, (2) it maintains a stable bath by retaining the copper and zinc values therein in solution, (3) it does not attack the metal substrate being treated therein, (4) it does not allow an immersion film of zinc or copper to form on the substrate being treated, and (5) it, and copper and zinc values complexed therewith, can be readily removble from rinse waters dcontaining such materials, as by treatment with lime.

The preferred of such chelating agents are the phosphorous containing chelating agents, and the amino carboxylic acids or the derivatives thereof. The pyrophosphate and phosphonates are the most preferred of these chelating agents since they, and any residual copper and zinc values, can be readily removed from waste rinse water used to rinse off substrates treated in such baths, by simply treating such waste water with lime, or other water soluble forms of calcium.

More extensive listings of useful organophosphorous ligands that may be used as chelating agents for the purpose of the present invention are disclosed in U.S. Pat. No. 3,475,293, the disclosure of which is hereby incorporated herein by reference.

The chelating agents are preferably used in the strike bath in an amount which is about 10 to 100 mol percent larger than the amount of chelating agent that would be expected to be needed to stoichiometrically complex with all of the copper and zinc values present in such baths. All of such copper and zinc values are, in fact, placed in solution, in chelated form, in such alkaline baths with the assistance of such chelating agents.

The pH of these baths is in the range of about 7 to 12, depending on the chelating agent used, as described in more detail below. Further, the quantity of the complexing or chelating agent to be used will vary with its molecular weight, and complexing power for the copper and zinc, and can vary from about 50 to 300 grams per liter. Thus, where two complexing agents have approximately the same complexing power for such metals, but have different molecular weights, a larger amount, by weight, of the higher molecular weight material would be needed to provide the same level of complexing functionality as a lesser amount, by weight, of a lower molecular weight chelating agent.

OPERATING CONDITIONS FOR THE STRIKE BATH

The temperature of operation of the strike baths can vary from room temperature (of about 70°–75° F.) to about 130° F., with about 85° to 110° F. being preferred. At higher temperatures, there is a danger of immersion deposition of the copper occurring, therefore, lower temperatures (<110° F.) are preferred. Current densities can vary from about 2 to 10 amps per square foot of surface area of the surface of the metal substrate being treated in the bath, with about 3 to 6 amps per square foot being preferred. The time of strike plating can vary from about 1 to 10 minutes or more in order to both deposit enough Cu-Zu metal from the strike bath onto the substrate being treated, as well as to protect the substrate from solution attack or immersion deposits in subsequent copper plating baths. Usually, about 2 to 3 minutes of striking time are sufficient. The length of time required will also vary depending on the depth of the strike coating that is desired. The strike coatings are usually applied in thicknesses of about 2 to 50 microinches, and preferably of about 3 to 10 microinches.

The pH of the strike bath is controlled within the desired limits therefor by adding alkali hydroxide thereto with the use of sodium or potassium hydroxide being preferred for this purpose. The preferred pH range to be used depends on the particular complexing or chelating agent being used, and this also depends upon the pH range in which this agent prevents copper or zinc immersion deposits on the substrate being strike coated. Below the lower limit (7.5) of the preferred pH range, copper tends to plate by immersion and above the limit of such range (12), zinc tends to immersion plate, on zinc die-cast substrates. For example, when using organic phosphonates as the complexing agent in the strike bath, copper will plate by immersion onto a zinc substrate at a pH velow about 7.5 and above about 11 zinc will immersion plate on a zinc substrate. If this strike bath did not contain zinc, copper would immersion plate on a zinc substrate even in the preferred pH range of 8–11. The presence of zinc prevents or substantially retards copper from immersion plating from these strike baths onto zinc based substrates. When using pyrophosphates as the chelating agents in the strike baths, the results are analogous to those when using organic phosphonates as the chelating agents. When using EDTA as the chelating agent in the copper-zinc alloy strike bath of the present invention, the preferred pH range is lower when strike coating zinc substrates. With EDTA, there will be copper immersion plating of the zinc substrate at a pH of 9, but no immersion plating at a pH of 7.5. The chelating power of the particular chelating agent used will determine the preferred operating pH range for the strike bath in order to obtain the best results for the strike coating of the particular metal substrate being strike coated. This preferred pH range can readily be obtained by experiment for each candidate chelating agent. In all cases, however, the strike bath must contain zinc in addition to copper since immersion plating might otherwise occur even within the preferred pH range.

The metal electro-plating bath that is used after the copper-zinc strike bath to plateover the strike coating should also be cyanide-free in order to have a completely cyanide-free plating system. An alkaline, cyanide-free copper plating bath can be used for this purpose, based upon the use therein of the same complexing or chelating agent that is also used in the strike bath. No zinc is needed in such plating baths. For a heavy copper plating build-up, the copper concentration in the plating bath should be much higher than that used in the strike bath, in order to permit higher plating speeds. After the heavy build-up of copper plating over the copper-zinc alloy strike, the substrate being coated is then generally further plated with nickel or bright nickel to a desired thickness, followed by a top coat of chromium from a suitable chromium plating bath.

Adhesion of the composite electrodeposit to the metal substrate part on which it is deposited, in accordance with the present invention, is generally tested by plating one-half to 1 mil of copper plus one to one and a half mil of nickel onto the copper-zinc alloy strike. The rinsed and dried part is then placed onto a hot-air oven maintained at about 125° C. for one hour. After cooling to ambient temperature (about 20°-25° C.), the part is examined visually for the presence of blisters which would indicate poor adhesion of the plating to the substrate. The part is also bent at right angles, at ambient temperatures, in a vise until broken. Any deposit lifting at the break would also indicate poor adhesion. Parts initially plated in the prior art alkaline copper (only) cyanide-free strike baths have not been able to pass these adhesion tests, whereas the copper-zinc alloy strike baths described herein can readily permit similarly plated parts to pass these tests. The adhesion obtained using the described strike baths compares favorably with that obtained when using conventional cyanide copper strike baths.

At higher concentrations of about >15 g/l of the copper and zinc, the tendency for immersion coating by both the copper and the zinc is increased.

Although this invention is primarily related to plating zinc based die-castings, as the metal substrate of choice, it is understood that the methods described herein can also be advantageously used for plating onto any part that has an outer coating of zinc. Zinc coatings can be achieved by zinc electroplating, hot dipping, zinc immersion coating onto aluminum or aluminum alloys obtained from commercially available zincate solutions commonly used for preparing these metals for subsequent electroplating, or by other methods. The strike baths, according to this invention, can also be advantageously used for plating onto brass and cast iron and some difficult-to-plate steels, such as those containing nickel.

The following examples are merely illustrations of the present invention and are not intended as a limitation upon the scope thereof.

EXAMPLE NO. 1

After suitable cleaning and acid dipping, a zinc based die-casting was initially strike coated in the following aqueous strike bath under the following conditions:

| | Concentration of Component |
|---|---|
| Component of Strike Bath | |
| Copper Metal (as copper hydroxide) | 3 grams/liter |
| Zinc Metal (as potassium zincate) | 3 grams/liter |
| Hydroxyethylidene diphosphonic acid | 130 ml/liter |
| Potassium hydroxide | sufficient to adjust the solution to pH 10 |
| Strike Bath Operating Conditions | |
| Temperature | 90° F. |
| Current density | 3-5 amps/sq. ft. |
| Time | 3 minutes |
| Agitation | mild |
| Deposit Analysis | 95% copper/5% zinc |
| Thickness of strike coating | about 3 to 8 microinches |

After suitable rinsing, the strike coated part was then electroplated with copper to a thickness of one-half mil from a cyanide-free copper plating electrolyte, based upon the use of the same complexing agent and containing 20 grams/liter of copper metal (and as otherwise described in U.S. Pat. No. 3,833,486). After the copper plating operation, the part was further plated with nickel to a thickness of 1 mil from a conventional bright nickel plating bath. The thus plated part was heat tested as described above and the plating showed good adhesion with no signs of blistering. Another suitably cleaned, unplated zinc die casting was immersed into the above strike bath for one-half minute without any current. No immersion deposits were observed.

EXAMPLE NO. 2

By way of comparison, Example No. 1 was repeated, however, in this example the zinc was not included in the strike bath. The same sequence of operations was followed and the part exhibited poor adhesion with blistering after the heat test. When a clean zinc based die-casting was immersed in the strike bath of Example No. 2, without current, a copper immersion film of about 1-2 microinches in thickness formed after about one-half minute, which film was non-adherent and smutty.

EXAMPLE NO. 3

After suitable cleaning and acid dipping a zinc based die casting was initially strike coated in the following aqueous strike bath under the following conditions:

| | Concentration of Component |
|---|---|
| Component of Strike Bath | |
| Copper Metal (as copper hydroxide) | 3.3 grams/liter |
| Zinc Metal (as potassium zincate) | 4 grams/liter |
| Ethylenediaminetetraaceticacid (EDTA) | 150 grams/liter |
| Potassium hydroxide | sufficient to raise pH to 8.5 |
| Strike Bath Operating Conditions | |
| Temperature | 95° F. |
| Current Density | 5 amps/sq. ft. |
| Time | 2 minutes |
| Agitation | None |
| Deposit Analysis | 90-95% Cu/5-10% Zn |
| Thickness of strike coating | about 3-8 microinches |

After being coated in the above strike bath, the die-casting was further plated using the same copper and nickel electrolytes described in Example No. 1. The adhesion of the composite electrodeposit was satisfactory after the heat test, with no signs of blistering.

EXAMPLE NO. 4

By comparison, a zinc based die-casting was strike coated in the same strike bath as was used in Example No. 3 for an initial strike bath with the exception, however, that in this case the zinc compound was not included therein. The same sequence of other plating operations was then followed as in Example No. 3, and the resultant composite electrodeposit was found to be poorly adherent, with blisters forming after the heat test.

EXAMPLE NO. 5

After suitable cleaning and acid dipping a zinc based die-casting was initially strike coated in the following aqueous strike bath under the following conditions:

| | Concentration of Component |
|---|---|
| Component of Strike Bath | |
| Copper Metal (as copper pyrophosphate) | 6.0 grams/liter |
| Zinc Metal (as sodium zincate) | 3.3 grams/liter |
| Potassium pyrophosphate | 250 grams/liter |
| Potassium hydroxide | sufficient to raise pH to 9.5 |

-continued

| | Concentration of Component |
|---|---|
| Strike Bath Operating Conditions | |
| Temperature | 90° F. |
| Current Density | 4 amps/sq. ft. |
| Time | 3 minutes |
| Agitation | None |
| Deposit analysis | 90-95% Cu/5-10% Zn |
| Thickness of strike coating | about 3-8 microinches |

After being plated in this copper strike bath, the die-casting was further subjected to the same plating sequence as was followed in the above examples, and the resulting composite electrodeposit was found to be adherent, with no blisters after the heat test. A clean zinc die-casting immersed in this bath for one-half minute also showed no immersion deposit.

EXAMPLE NO. 6

In this example a zinc based die-casting was strike coated in the same strike bath that was used in Example No. 5; with the exception, however, that in this case the zinc compound was not included in such bath. The same complete plating sequence was used as in Example No. 5, and the resulting composite electrodeposit was found to be poorly adherent to the substrate with blisters showing after the heat test. A clean zinc die-casting immersed in this bath showed copper immersion to a thickness of about 1-2 microinches.

EXAMPLE NO. 7

A bath of the Example 1 composition was further adjusted with KOH to a pH of 12.5. At this pH, a zinc die-casting placed therein was slightly attacked by the bath and zinc plated out by immersion after about 30 seconds in the bath. A composite electrodeposit deposited on such strike coated substrate was poorly adherent to such substrate.

When tested in the vise test procedure described above the composite electrodeposits of Examples 1, 3 and 5 have good adhesion to the substrates on which the electrodeposit was made. The electrocomposites made in the other examples are poorly adherent to their substrates when tested by such vise test procedure.

The substrates treated in these examples were commercially available zinc based die-castings.

EXAMPLE NO. 8

For comparison purposes, a plating bath was also made following the disclosures in U.S. Pat. No. 4,356,067. An aqueous bath was thus made which contained:

| Component of Bath | Concentration of Component |
|---|---|
| Copper Metal [as $Cu(OH)_2$] | 3.5 grams/liter |
| Zinc Metal (as sodium zincate)* | 3.3 grams/liter |
| $CH_2OH(CHOH)_5COONa$ | 160 grams/liter |
| NaOH | sufficient to raise pH to 9.0 |

*The sodium zincate was preformed from NaOH and ZnO.

The zinc in this bath, at a pH of 9.0, was not dissolved. The pH of the bath was further adjusted to 11.5 with NaOH, and the zinc was still undissolved. The pH of the bath was further adjusted to 13.3 with NaOH and a zinc suspension formed. This was filtered out, and was found to be a gelatinous matter containing zinc.

Attempts were made to electroplate standard commercially available zinc based die castings with each of the three baths prepared above, i.e., with pHs of 9.0, 11.5, and 13.3 respectively. Temperature, current density and time were as in Example 1. The parts were strike plated in the baths prepared above, then each was further overplated, successively, with 0.5 mil copper and 0.4 mil of nickel. The resulting composite coatings all failed the hot air oven test described above, and showed poor adhesion and blistering after a ½ hour test period in the oven.

The strike baths of the present invention are storage stable in dilute or concentrated form at temperatures of about 20°-30° C. for indefinite periods of time.

The strike baths of the present invention can be used in a batch-wise or continuous mode of operation. The pH and the level of the complexing agent in such baths will not vary much during such operation, but the levels of copper and zinc in the baths will obviously be lowered as such metals are removed in the form of the strike coatings. The desired levels of all of these essential components of the baths are normally maintained during the operation of the bath to assure that the desired levels of such materials are maintained therein by replenishing any such values removed therefrom. Analytical tests of the type that may be used to monitor the desired levels of such essential materials in the strike baths are disclosed in U.S. Pat. No. 4,356,067, and in trade publications such as *Metal Finishing Guide Book Direction,* 1984, *Metals and Plastics Publications Inc.,* Hackensack, N.J., the disclosures of which are incorporated herein by reference.

The strike baths of the present invention do not require the use of strong agitation, particularly agitation sponsored by ultrasonic vibrations. Mild agitation may be used.

What is claimed is:

1. An alkaline cyanide-free strike bath capable of electrodepositing a copper-zinc alloy onto a substrate comprising zinc and consisting essentially of, dissolved in chelated form therein, copper, zinc, and chelating agent for said copper and zinc, said bath having a pH of about 7.5 to 12.0, each of said copper and zinc being present in amounts of about 1 to 15 grams/liter, and said chelating agent being capable of chelating divalent metal ions and being selected from the group consisting of organic phosphonic acids, organic phosphonates, pyrophosphates, polyphosphates, aminocarboxylic acids, 1,3-diketones, amino alcohols, aromatic heterocyclic bases, phenols, oximes, Schiff bases, tetrapyrroles, sulfur compounds, polyethylenimine, polymethacryloylacetone, and poly(p-vinylbenzyliminodiacetic acid) and derivatives and mixtures thereof, and being present in excess of the amount thereof required to completely complex the amount of copper and zinc present therein.

2. A strike bath as in claim 1 in which said copper and zinc are present in said bath in a weight ratio to each other of about 2 to 1 of copper to 0.5 to 1 of zinc.

3. A strike bath as in claim 2 comprising about 3 to 5 grams/liter of zinc.

4. A strike bath as in claim 3 comprising about 3 to 5 grams/liter of copper.

5. A strike bath as in claim 1 in which said chelating agent is selected from the group consisting of organic phosphonic acids, organic phosphonates, pyrophosphates, polyphosphates, aminocarboxylic acids and derivatives thereof, and mixtures of such complexing agents.

6. An alkaline cyanide-free strike bath capable of electroplating a copper-zinc alloy onto a substrate comprising zinc and without forming immersion coating comprising, dissolved in chelated form therein, copper, zinc and chelating agent for said copper and zinc, each of said copper and zinc being present in an amount of about 1 to 15 grams/liter, and said chelating agent being capable of chelating divalent metal ions and being only selected from the group consisting of pyrophosphates, organic phosphonic acids, organic phosphonates, polyphosphates, aminocarboxylic acids, 1,3-diketones, amino alcohols, aromatic hetrocyclic bases, phenols, oximes, Schiff bases, tetrapyrroles, sulfur compounds, polyethylenimine, polymethacryloylacetone, and poly(p-vinylbenzyliminodiacetic acid) and derivatives and mixtures thereof, and being present in excess of the amount thereof required to completely complex the copper and zinc values present therein, and said strike bath having a pH of about 7.5 to 12.0.

7. A strike bath as in claim 6 wherein said complexing agent is selected from the group consisting of organic phosphonic acids, organic phosphonates, pyrophosphates, polyphosphates, aminocarboxylic acids and derivatives thereof and mixtures of such complexing agents.

8. A strike bath as in claim 1 which contains a phosphorous containing chelating agent.

9. A strike bath as in claim 8 in which said chelating agent consists of hydroxyethylidene diphosphonic acid.

10. A strike bath as in claim 8 in which said chelating agent consists of pyrophosphates.

11. A strike bath as in claim 8 in which said chelating agent is nitrilotrimethylene phosphonic acid.

12. A strike bath as in claim 7 which has a pH of about 7.5 to 9.0.

13. A strike bath as in claim 12 in which said chelating agent is ethylenediaminetetraacetic acid.

14. In a multistep electroplating process for electroplating a metal substrate comprising zinc with a copper coating without forming an immersion coating which process includes the step of electrodepositing an initial copper containing strike coating onto said substrate from an alkaline strike bath having a pH of about 7.5 to 12.0 and which is free of cyanide and glucoheptonic acid and salts thereof, the improvement which comprises adding zinc to said strike bath to prevent or retard the plating of copper on said substrate by immersion.

15. A process as in claim 14 in which said strike bath contains each of said copper and zinc in an amount of about 1 to 15 grams/liter.

16. A process as in claim 15 in which said strike bath contains chelating agent for said copper and zinc in an amount in excess of the amount thereof required to completely complex the amounts of copper and zinc present therewith.

17. A process as in claim 16 in which said strike bath comprises about 3 to 5 grams per liter of copper.

18. A process as in claim 17 in which said strike bath comprises about 3 to 5 grams per liter of zinc.

19. A process as in claim 18 in which said chelating agent is selected from the group consisting of organic phosphonic acids, organic phosphonates, pyrophosphates, polyphosphates and aminocarboxylic acids and derivatives thereof, and mixtures of such complexing agents.

20. A process as in claim 19 in which said strike bath has an operating pH of about 7.5 to 11.

21. A process as in claim 20 in which said chelating agent is an organic phosphonate.

22. A process as in claim 20 in which said chelating agent is a pyrophosphate.

23. A process as in claim 20 in which said chelating agent is ethylenediaminetetraacetic acid and said pH is in the range of about 7.5 to 9.

24. A process as in claim 14 in which said chelating agent consists of hydroxyethylidene diphosphonic acid.

25. A process as in claim 14 in which said chelating agent consists of pyrophosphates.

26. A process as in claim 14 in which said chelating agent is ethylenediaminetetraacetic acid.

27. A process as in claim 14 in which said metal substrate is a zinc based die casting.

28. A process as in claim 14 in which said strike is a coating about 2 to 50 microinches thick.

29. A process as in claim 28 in which said strike is a coating about 3 to 10 microinches thick.

30. An alkaline cyanide-free strike bath having a pH of about 7.5 to 11 and capable of electrodepositing a copper-zinc alloy onto a substrate comprising zinc without forming an immersion coating and consisting essentially of, dissolved in chelated form therein, copper, zinc and chelating agent for said copper and zinc, each of said copper and zinc being present in an amount of about 1 to 15 grams/liters and said coper and zinc being present in a weight ratio to each other, in elemental form, of about 2 to 1 of copper to 0.5 to 1 of zinc, and said chelating agent being capable of chelating divalent metal ions and being a phosphorous containing compound selected from the group consisting of pyrophosphates, polyphosphates, organic phosphonates, and organic phosphonic acids.

31. A strike bath as in claim 30 in which said phosphorous containing compound is a pyrophosphate.

32. A strike bath as in claim 30 in which said copper and zinc are present in a weight ratio of about 1:1.

33. A strike bath as in claim 30 in which said chelating agent is hydroxyethylidene diphosphonic acid.

* * * * *